United States Patent [19]

Madray

[11] Patent Number: 4,720,957

[45] Date of Patent: Jan. 26, 1988

[54] STRUCTURAL COMPONENT

[76] Inventor: Herbert R. Madray, P.O. Box 712, Okeechobee, Fla. 33472

[21] Appl. No.: 797,029

[22] Filed: Nov. 12, 1985

Related U.S. Application Data

[63] Continuation-in-part of Ser. No. 709,317, Jan. 22, 1985, which is a continuation-in-part of Ser. No. 496,960, May 23, 1983, Pat. No. 4,551,957.

[51] Int. Cl.[4] ..... E04B 1/18; E04C 3/32

[52] U.S. Cl. ..... 52/732; 52/90

[58] Field of Search ..... 52/732, 720, 220, 221, 52/90

[56] References Cited

U.S. PATENT DOCUMENTS

| | | | |
|---|---|---|---|
| 1,850,118 | 3/1932 | Meyers | 52/732 X |
| 1,975,228 | 10/1934 | Grumman | 52/732 |
| 2,284,898 | 6/1942 | Hartman | 52/732 X |
| 3,255,563 | 6/1966 | Sauer | 52/732 X |
| 4,172,677 | 10/1979 | Gunti | 52/732 X |

FOREIGN PATENT DOCUMENTS

| | | | |
|---|---|---|---|
| 1010752 | 11/1965 | United Kingdom | 52/732 |

*Primary Examiner*—J. Karl Bell

*Attorney, Agent, or Firm*—Steel, Gould & Fried

[57] ABSTRACT

A component for erecting buildings and the like comprises a channel member preferably having a substantially squared-off C-shaped cross section with web portion, two flange portions on the web portion and two inwardly directed lips on the flange portions. A repeating pattern of longitudinally spaced large diameter apertures is provided in the web portion. A longitudinally repeating pattern of small diameter apertures is also provided in the web portion. A longitudinally repeating pattern of apertures is provided in each flange portion including a pentad with an aperture at four corners, defining an imaginary square and an aperture at the center of the square. A plurality of apertures is also provided in the inwardly directed lips. The building component is widely adaptable to a variety of different uses in building construction systems and for innumerable building designs.

14 Claims, 22 Drawing Figures

STRUCTURAL COMPONENT

CROSS REFERENCE TO RELATED APPLICATIONS

This application is a continuation-in-part of the Applicant's co-pending U.S. patent application Ser. No. 709,317, filed Jan. 22, 1985, which is the U.S. national phase application of Applicant's PCT application Ser. No. PCT/US 84/00782 filed May 22, 1984, which is a continuation-in-part of Applicant's co-pending U.S. patent application Ser. No. 496,960, filed May 23, 1983 now U.S. Pat. No. 4,551,957.

BACKGROUND OF THE INVENTION

1. Field of the Invention

This invention relates generally to a structural component, and more particularly to a channel member that is widely adaptable to various building construction systems.

2. Description of the Prior Art

It is known that prefabricated building construction systems offer significant advantages over conventional building techniques. The time required to assemble a prefabricated building is usually only a fraction of the time required to assemble a building according to traditional techniques. The resulting manpower requirements for erection of the building are correspondingly reduced. Another important advantage of using prefabricated components is that the number of skilled workers that are required to assemble the structure is reduced. Assembling prefabricated components in general requires much less job skill than is necessary to perform the carpentry and other jobs associated with traditional building techniques. High skilled labor costs and production time cost to training are avoided.

Prefabrication has some significant drawbacks. The builder is obviously limited to the prefabricated design. It is desirable for marketing purposes that a development of single family homes include several different models. The costs for fabricating several models, however, can decrease the cost savings that prefabrication might otherwise provide. In some instances prefabrication may be all but impossible. In larger building constructions, for example, motels and other commercial buildings which typically are at least in some respects unique for any given site, the cost of prefabrication usually precludes any benefits that could result from prefabrication. Design changes are often desired or necessary during construction. Such changes are difficult, if not impossible, with a prefabricated structure. The quality of prefabricated structures is often inferior to those constructed by conventional techniques.

It would be desirable to provide a structural member which could be used in a variety of construction systems without modification. Such a component must of course possess sufficient strength and resistance to damage to be useful as a building component. Such a component would preferably be resistant to water damage, fire, and insects. The component would also preferably be adaptable to environments ranging from minor stresses to the extreme loads of larger building constructions. Importantly, the component should be versatile in its utility for different applications within a building construction. The component would therefore be connectable, and interconnectable, in many different ways. It is also desirable, however, that a minimum amount of labor, and especially skilled labor, be required to assemble the building construction components or materials. It is therefore desirable that the component be connectable and interconnectable without the need for drilling holes for each particular application. It would be desirable if the component could be utilized by simply positioning the component of proper length in place and securing it there with suitable fastening structure. It would also be desirable if such a component could be manufactured with a precision generally not possible with conventional techniques and components.

SUMMARY OF THE INVENTION

It is an object of the invention to provide a building component that is adaptable to a variety of applications in building construction systems.

It is another object of the invention to provide a building component which possesses the strength required for many building construction applications.

It is still another object of the invention to provide a building component which can produce structural members able to withstand great loads.

It is another object of the invention to provide a building component which resists deterioration.

It is yet another object of the invention to provide a building component which can be connected and interconnected with additional building structure.

It is another object of the invention to provide a building component which can be utilized by relatively unskilled labor.

It is still another object of the invention to provide a building component which requires fewer man hours to utilize than conventional components and techniques.

It is another object of the invention to provide a building component which can be incorporated into many building applications without the necessity of drilling custom holes or otherwise adapting the component for fastening in particular places except for properly dimensioning the length of the component.

It is another object of the invention to provide a building component which can be rapidly manufactured from materials other than wood and moreover, materials having certain properties superior to those of wood for building construction system.

It is yet another object of the invention to provide a building component which can be manufactured with great precision.

It is still another object of the invention to provide a building component which is relatively inexpensive to produce.

These and other objects are accomplished by a building component comprising a channel member having a substantially squared-off C-shaped cross section with a web portion, two flange portions extending from the web portion, and inwardly directed lips on each of the flange portion. A repeating pattern of longitudinally spaced large diameter apertures is provided at the center of the web portion. A repeating pattern of small diameter apertures is also provided in the web portion. A repeating pattern of apertures in each flange portion includes a pentad with an aperture at each corner of an imaginary square and an aperture at the center of the square. A plurality of apertures are also formed in the inwardly directed lips.

The repeating pattern of smaller diameter apertures in the web portion preferably includes longitudinal rows of evenly spaced apertures at each lateral side of the longitudinally spaced larger diameter apertures.

Three rows are preferably laterally aligned, while the middle row is staggered to provide apertures at the longitudinal midpoint between the apertures of the lateral innermost and outermost rows.

The plurality of apertures in the inwardly directed lips are preferably provided in longitudinal rows. The apertures in the flanges preferably are longitudinally and laterally aligned.

At least one longitudinal row of apertures preferably separates the pentads in the side portions, Preferably a laterally centered single row of two longitudinally spaced apertures separates the pentads.

The channel members so provided have significant strength but also can be interconnected to produce compound structural members with great strength. The many different repeating patterns of apertures along the longitudinal length of the channel member result in a component which is widely adaptable for many applications in building construction systems. The component can be made from a variety of materials which resist deterioration. The component is easily installed in its various applications by relatively unskilled labor and in less time than is usually required for conventional techniques and components. The component can be connected and interconnected in many ways and in many applications without the need for drilling holes. It is only necessary to position such a component of proper length in place and secure it with the appropriate fastening structure.

The building component can be formed with great precision. Current manufacturing techniques allow the substantially continuous production of a component according to the present invention with little deviation in the dimensions and patterns from one section of the component to another. Potential errors which might be introduced when cutting the component into proper lengths for utilization in its various applications can be substantially eliminated. The large diameter apertures can be used as locaters for a computer controlled cutting mechanism such that manufacturing tolerances are kept to a minimum and are much less than in known prefabricated systems.

BRIEF DESCRIPTION OF THE DRAWINGS

There are shown in the drawings forms and embodiments presently preferred, it being understood, however, that the invention is not limited to the precise arrangements and instrumentalities shown therein.

DESCRIPTION OF THE PREFERRED EMBODIMENTS

Figure 1:
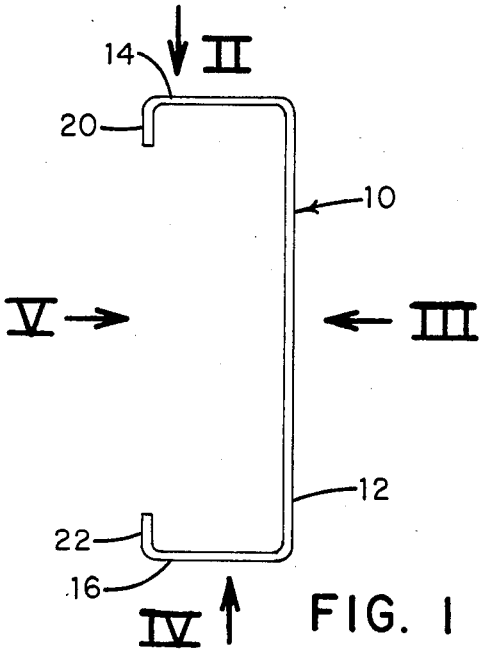
FIG. 1 is a cross section of a component according to the present invention.

The disclosures of Applicant's co-pending U.S. application, Ser. Nos. 496,960, filed May 23, 1983; U.S. Pat. No. 4,551,957; Ser. No. PCT/US 84/00782, filed May 22, 1984; Ser. No. 678,505, filed Dec. 5, 1984; Ser. No. 678,507, filed Dec. 5, 1984; Ser. No. 678,508, filed Dec. 5, 1985; Ser. No. 709,317, filed Jan. 22, 1985; Ser. No. 723,282, filed Apr. 15, 1985 now U.S. Pat. No. 4,569,169; and Ser. No. 723,349, filed Apr. 15, 1985 now abandoned; are hereby incorporated fully by reference. These applications disclose certain of the Applicant's methods and apparatus for constructing a building structure using a series of complementary pre-engineered components which can be interconnected on site in innumerable ways to form a variety of integral building structures without the need for complete prefabrication for any particular step.

A preferred embodiment of the present invention is shown in FIGS. 1–6. A component generally designated 10 comprises a channel member having a substantially squared-off C-shape in cross section, with a web portion 12, two flange portions 14 and 16 extending from web portion 12, and two inwardly directed lips 20 and 22, attached to flange portions 14, 16, respectively. The squared-off C-shape provides excellent strength characteristics for a given weight of material. The inwardly directed lips 20 and 22 not only provide excellent strength characteristics, but also serve as a point of attachment for various other building components.

The component 10 includes a plurality of apertures specially positioned to give the component maximum versatility without the necessity of drilling holes. The web portion 12 includes a plurality of longitudinally spaced large diameter apertures 24 preferably at the center of the web portion, the longitudinal direction being construed as the line intersecting both of the broken ends of the component shown in the figures, that is, along the length of component 10. The large diameter apertures 24 permit a number of uses. They can be used to secure the component 10 to other components and structure by bolts or other large diameter fastening means to provide a sturdy connection when necessary. They can also serve as passage or support of wiring, small diameter plumbing, and the like, passing through aligned large apertures in successive spaced components 10.

The large diameter apertures are also used as pilot holes for accurate shearing of the component into proper lengths for various applications. According to rollforming techniques, the product is preferably produced in a continuous or semi-continuous process. Production time is detrimentally increased if the continuous flow of product through the rollformer is stopped to effect shearing. A procedure known as "flying cut-off" can be used to save production time. In this process, the cut-off blade assembly travels synchronously with the product as it moves on a track, located on a machine press positioned after the rollformer. In this manner, the blade assembly can effect transverse shearing without halting or slowing the flow of product through the rollformer. After each successive shear, the blade assembly is returned to a beginning span along the track to effect the next successive shear.

Accurate shearing by the "flying cut-off" method requires accurate positioning of the product in the cut-off die assembly. This can be accomplished by utilizing a pilot pin-pilot hole process. A pilot pin actuated by pneumatic means is disposed in the cut-off die mechanism. A series of pilot holes in the product move under the pilot pin, whereupon the pilot pin is driven into a pilot hole to thereby lock the product in precisely correct and repeatable position in relation to the blade assembly. The product is sheared accurately by the machine press supplying the necessary force on the aligned blade against the product. Actuation of the press is preferably by a computer controlled system. Very precise shearing is made possible by this method. The large diameter apertures can be utilized as pilot holes to provide for very precise shearing of the product into components of accurate length and in continuous or semi-continuous process. Since many of the components necessary to complete a building structure can be formed or partially formed by a component according to the present invention, albeit in different lengths, it is possible to pre-program the shearing mechanism to cut all of the necessary lengths for the various components according to the invention for a particular building design in a single production run.

The web portion 12 also includes a plurality of apertures of a smaller diameter than the large diameter apertures 24. The small diameter apertures 30 in web 12 are preferably provided on each lateral side of the large diameter apertures 24. The smaller apertures preferably include longitudinal rows of evenly spaced apertures at each lateral side of the longitudinally spaced larger diameter apertures. Three rows are preferably provided at each lateral side of the row of the large diameter apertures 24, comprising lateral innermost rows 29, middle rows 30, and outermost rows 31. The apertures of the lateral innermost rows 29 and outermost rows 31 are preferably aligned in their longitudinal positions on the component, while the apertures of the middle rows 30 are longitudinally staggered with regard to rows 29 and 31 to provide apertures at the longitudinal midpoint between the apertures of the lateral innermost and outermost rows. The staggered middle rows 30 of the small diameter apertures on each lateral side of the web portions 12 thereby provide apertures at every longitudinal half space relative to the longitudinal positions of the apertures of the innermost rows 29 and outermost rows 31. The rows of small diameter apertures on each lateral side of the longitudinal row of larger diameter apertures 24 are preferably symmetric about the longitudinal row of larger diameter apertures 24.

The small diameter apertures on web 12 are used to attach the component 10 to building structure including other components according to the invention, brackets, and adaptors as for example in Applicant's co-pending applications listed above and as set forth in Applicant's co-pending application entitled "Construction System", Ser. No. 797,028, filed concurrently herewith Nov. 12, 1985 now U.S. Pat. No. 4,688,358

The innermost rows of holes 29 are used to connect components web-to-web and at right angles to one another, and to attach the component to additional structures such as special adaptors and the like. The middle row of apertures 30 is useful for attaching the component to adaptors, bridging, bar joists, track members, and for forming box beams.

Figure 2:
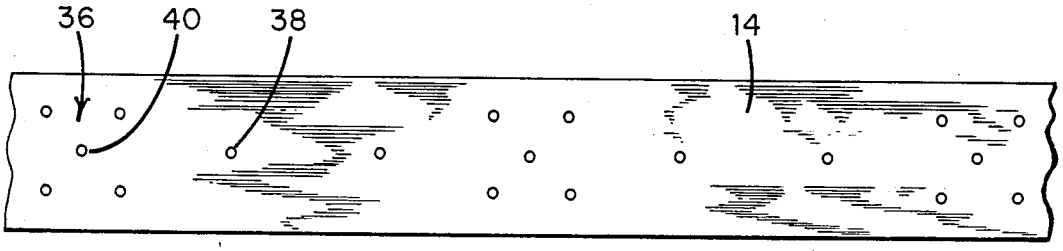
FIG. 2 is an elevation view taken according to the arrow II in FIG. 1.
Figure 3:
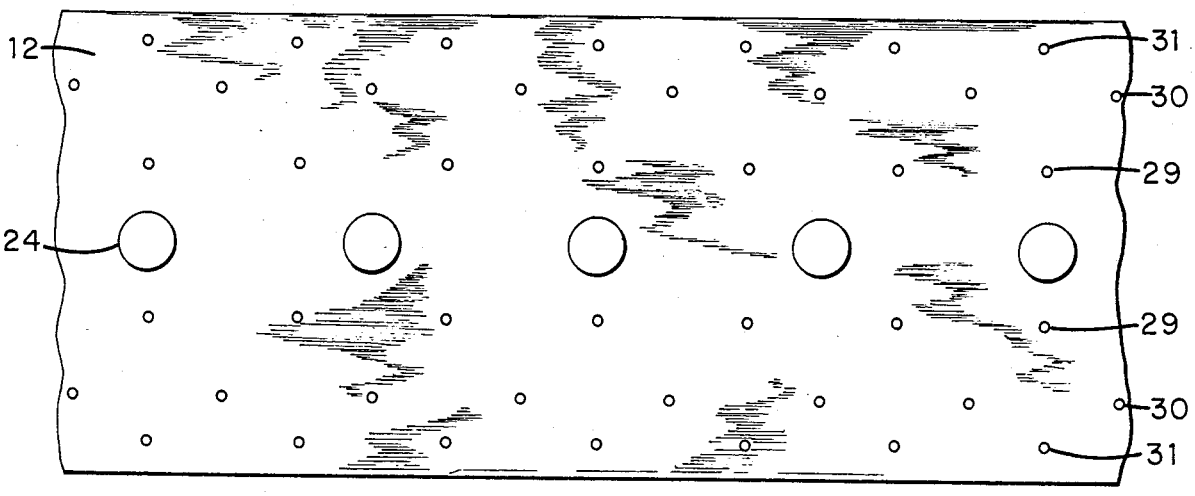
FIG. 3 is an elevation view taken according to the arrow III in FIG. 1.
Figure 6:
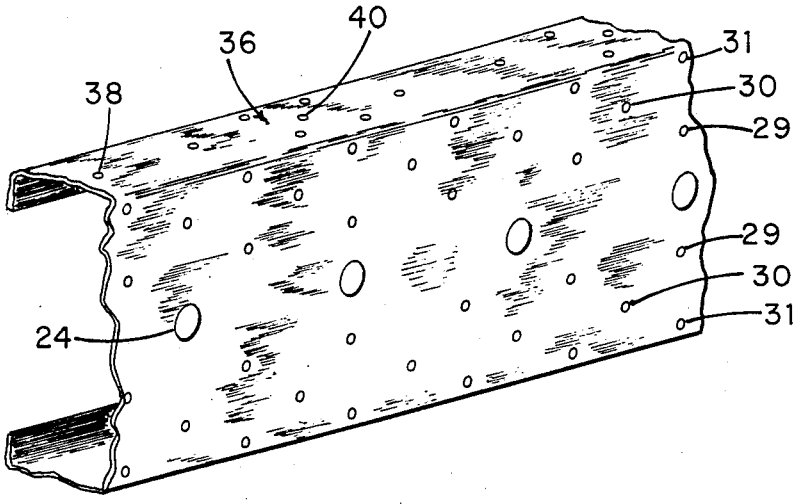
FIG. 6 is a perspective view of a component according to the invention.
Figure 4:
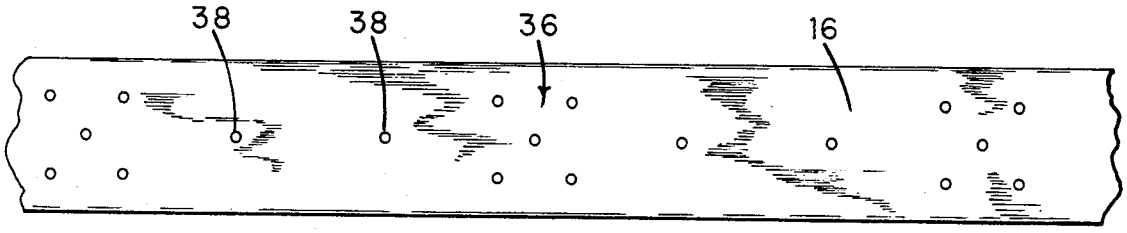
FIG. 4 is an elevation view taken according to the arrow IV in FIG. 1.
Figure 5:
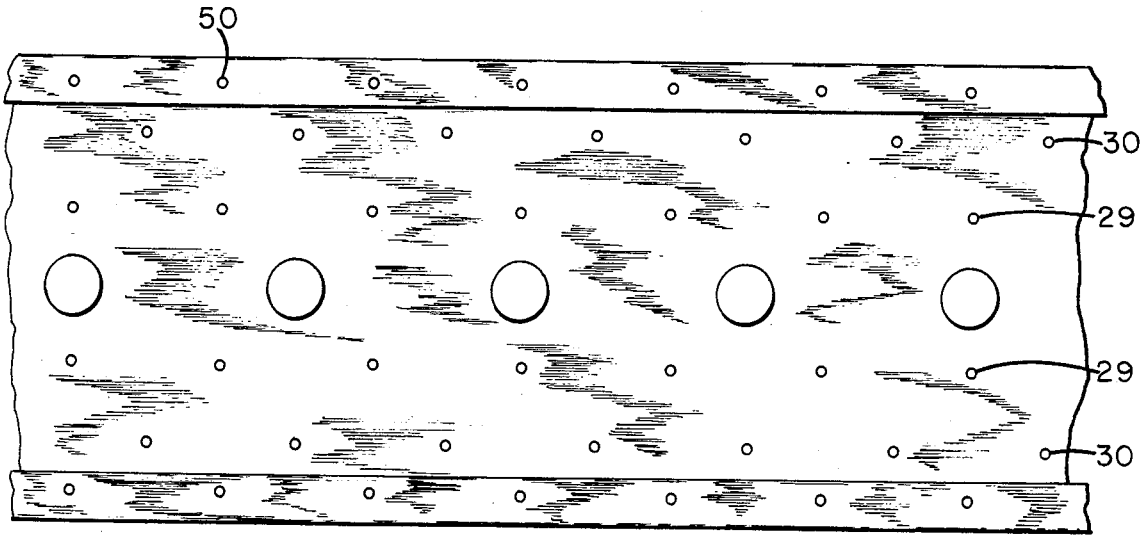
FIG. 5 is an elevation view taken according to the arrow V in FIG. 1.

The flange portions 14, 16 are provided with a plurality of apertures. The flange portion apertures are preferably provided as a repeating pattern in the longitudinal direction of each flange portion; the pattern including a pentad 36 (i.e., a five-hole formation) with an aperture at each corner of an imaginary square and an apertures at the center of the square. In one embodiment, at least one longitudinal row of apertures 38 separates the pentads. A longitudinal row of apertures 38 is preferably laterally centered on the flange portions and aligned with the center apertures 40 of each pentad 36. The longitudinal row so provided preferably has apertures at the same longitudinal positions as the apertures of the innermost rows 29 and outermost rows 31 on the web portion 12. Preferably two apertures 38 longitudinally separate each center pentad aperture 40 as shown in FIG. 2. Alternatively, the pentads could be provided in a continuous pattern in which corner apertures each are associated with two adjacent pentads.

The pentad pattern is extremely verstile in the manner in which it can be used to connect the component 10 to the other components and structure. The pentad is symmetric about two axes. Rotation of a pentad on one component with relation to a pentad on an adjacent component can therefore still result in alignment of all five apertures in the pentads for the reception of suitable fastening means. In this manner the components can be secured together at right angles with assured alignment of the apertures in adjacent pentads for the reception of fastening means. The pentad apertures 36 of the side portions 14, 16, can be used variously to attach the component to siding, roofing, V-bracing, metal rib lathe, screeds, footing tracks, and other building parts. The longitudinal row apertures 38 of the side portions 14, 16 can be used to attach the component to V-bracing and metal lathe, as well as to make component to component connections.

The inwardly directed lip portions 20, 22 are provided with a plurality of apertures 50. The aperatures 50 are preferably provided as a row down the longitudinal length of the inwardly directed lip portions 20, 22. The apertures in the inwardly directed lip portions 20, 22 are useful for attaching components according to the present invention to adapters and brackets as set forth in Applicant's co-pending applications listed above and in Applicant's co-pending Application titled "Construction System" filed concurrently herewith on Nov. 12, 1985, Ser. No. 797,028 now U.S. Pat. No. 4,688,358. Component to component connections, as well as the attachment of other building structure, are also possible with the apertures. The apertures 50 are preferably spaced equally and are longitudinally aligned with the outermost rows of apertures 31 in the web portion 12. In this manner, the components may be reversed in orientation while retaining equivalently-positioned rows of apertures for the attachment of additional structure.

Components according to the structure are particularly useful in such building construction systems as wall studs, floor joists, roof rafters, door/window headers, window sills, and other diverse framing parts. The provision of apertures according to the invention allows great versatility in the manner in which components can be interconnected and connected to other building structure. Some of the multitude of uses for the component are described in Applicant's co-pending applications listed above and Applicant's co-pending applications filed herewith, entitled "Construction System", Ser. No. 797,028 now U.S. Pat. No. 4,688,358, and "Method and Apparatus for Constructing Building Structures", Ser. No. 796,915, the disclosures of which are herein fully incorporated by reference. The components can be rotated or moved in one direction or another and apertures in the component will align with apertures in other components to receive fastening means such as screws and the like. In this manner, drilling holes is not necessary for almost all conceivable uses of the component. Accurate installation of the components can be accomplished with little more than a screwdriver or the like and by a pocketful of screws, by relatively unskilled labor.

The versatility of a component according to the invention allows its incorporation in a wide variety of different settings, with the necessity of only modifying the length of individual components. This can be accomplished precisely in the rollforming process. The provision of the large diameter apertures 24 which serve as pilot holes during the shearing process and which permit precise shearing of the components to proper lengths obviates the need for skilled laborers modifying the components on site so that they fit together. Also, computer programming would make it possible to produce a substantial portion of all of the components of a building structure from a single rollformer by producing a series of components of varying but appropriate lengths for the various components of a building structure.

The lattice work of apertures provided by the invention is conveniently produced by a semi-continuous or continuous process as would be apparent to one skilled in the art in which the sheet-like, coil stock starting product is pre-punched on a mechanical press before rollforming, or pre-pierced by a rotary die during rollforming. This process could be otherwise accomplished as would be apparent to one skilled in the art.

Preferred dimensions of a structural component according to the present invention are included by way of illustration only and should in no manner be construed as limiting. A preferred structural component has a web portion 12 with a width of 6" (15.2 cm), flange portions 14, 16 with widths of 2" (5.1 cm), and lips 20, 22 with widths of $\frac{5}{8}$" (1.6 cm). The large diameter apertures 24 in the web portion 12 preferably have a diameter of $\frac{3}{4}$" (1.9 cm), and are spaced longitudinally apart by 3" (7.6 cm) from center to center. The small diameter apertures 30 in the web portion 12 would preferably have a diameter of 11/64", (0.4 cm) and are spaced longitudinally 2" (5.1 cm) from center to center. If three longitudinal rows of small diameter apertures are provided on each lateral side of the large diameter apertures 24, the innermost rows 29 of small diameter apertures are preferably spaced laterally 1" (2.5 cm) from the large diameter apertures 24, from the center. The middle rows 30 are preferably spaced 1" (2.5 cm) laterally from the innermost rows 29, from a line through the centers of one row to a line through the centers of another row. The outermost rows 31 are preferably spaced $\frac{3}{8}$" (1 cm) from the adjacent lateral edge of the web 12 and $\frac{5}{8}$" (1.6 cm) from the middle rows, from a line through the centers of one row to a line through the centers of another row. The apertures in the side portions 14, 16 preferably have a diameter of approximately 11/64" (0.4 cm). The apertures at the corners of the pentads 36 would preferably be spaced apart approximately 1" (2.5 cm) on a side of the imaginary square. The longitudinal row apertures 38 and center apertures 40 are preferably laterally centered in the flange portions 14, 16 and are preferably spaced 2" (5.1 cm) from center to center. The longitudinal apertures 50 in the inwardly directed lip portions 20, 22, are preferably spaced apart approximately 2" (5.1 cm) from center to center. The centers of the apertures 50 are preferably spaced $\frac{1}{4}$" (0.6 cm) from the laterally inward edge of the lips 20, 22. In this manner, it can be seen that the apertures 50 of the inwardly directed lips are equally spaced and laterally equivalent positions with the apertures of the outermost rows 31 and preferably are also at equivalent longitudinal positions with the apertures of the outermost rows 31 such that the orientation of the component can be reversed while retaining equivalently positioned rows of apertures for attachment to additional structure. The pattern of apertures on the component, if so dimensioned, repeats itself every longitudinal 6" (15.2 cm) for convenient increments in sizing. It should be understood that a component, according to the invention, can be formed with spacing down to less than 1/32" (0.08 cm) and accordingly reverse interfitting of components with other structure is possible.

Figure 7:
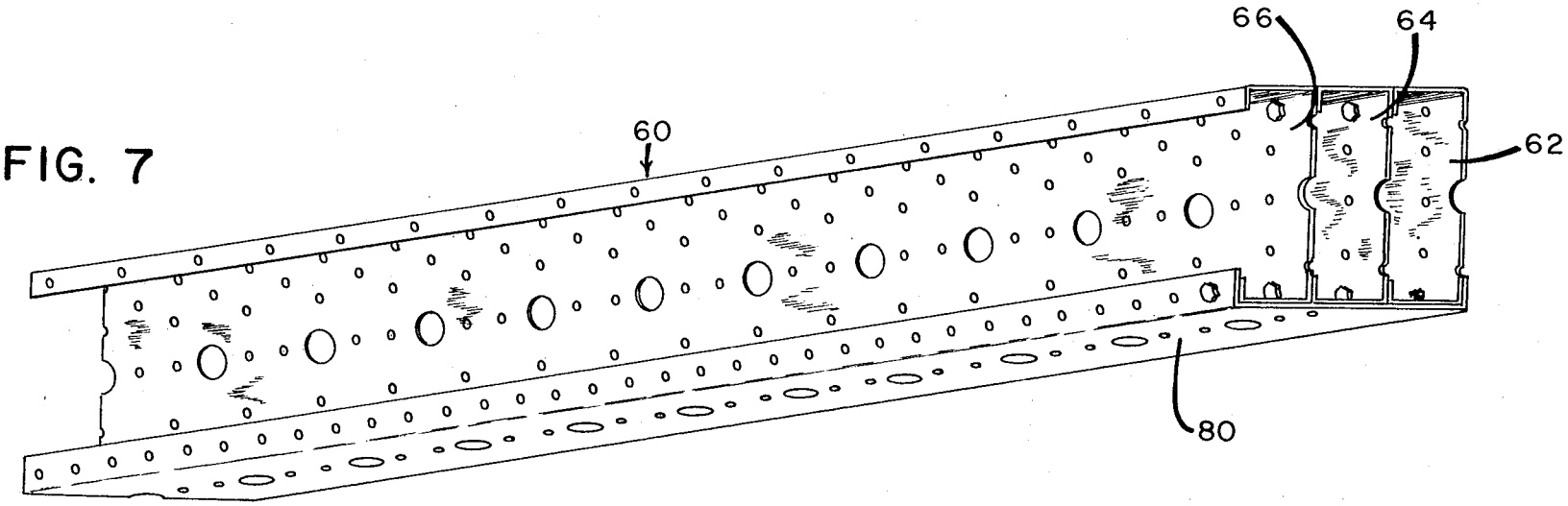
FIG. 7 is a perspective view of a compound component according to the invention.
Figure 8:
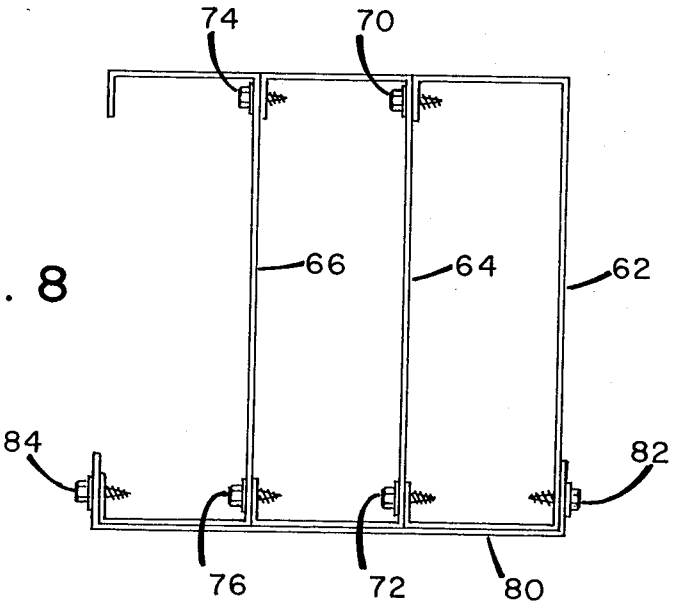
FIG. 8 is a cross section of the compound component of FIG. 7.

It is believed that the single components according to the invention are perfectly adequate for supporting the load of traditional single-family dwellings, and also multiple-story buildings up to three or four stories. In settings where greater stresses are encountered, additional support may be provided by combining basic components according to the invention, into compound components. One example of such a component is shown in FIGS. 7–8. FIGS. 7–8 show a compound component 60 in which three single components 62, 64, and 66 according to the invention are fastened substantially front to back. The inwardly directed lips of the component 62 are fastened by suitable means such as screws 70, 72 to the back of the web portion of the component 64. This connection is made simple by the alignment of apertures on the inwardly directed lips with the outermost rows of apertures on the web portion, as previously described. The inwardly directed lips of the component 64 are similarly fastened to the back of the web portion of the component 66 by screws 74, 76. It will be appreciated that any number of components may be connected in this fashion to produce compound structural elements of great strength. In this manner, very large multi-story constructions with very large loads can be constructed according to the invention, with one primary type of structural component.

An upwardly-opening channel member 80 of U-shaped cross-section may be included to firmly hold the compound component together. The channel member 80 may be joined to the component by fastening screws 82 to the web portion of the girder member 62, and by fastening screws 84 to the inwardly directed flange of the girder member 66.

Figure 9:
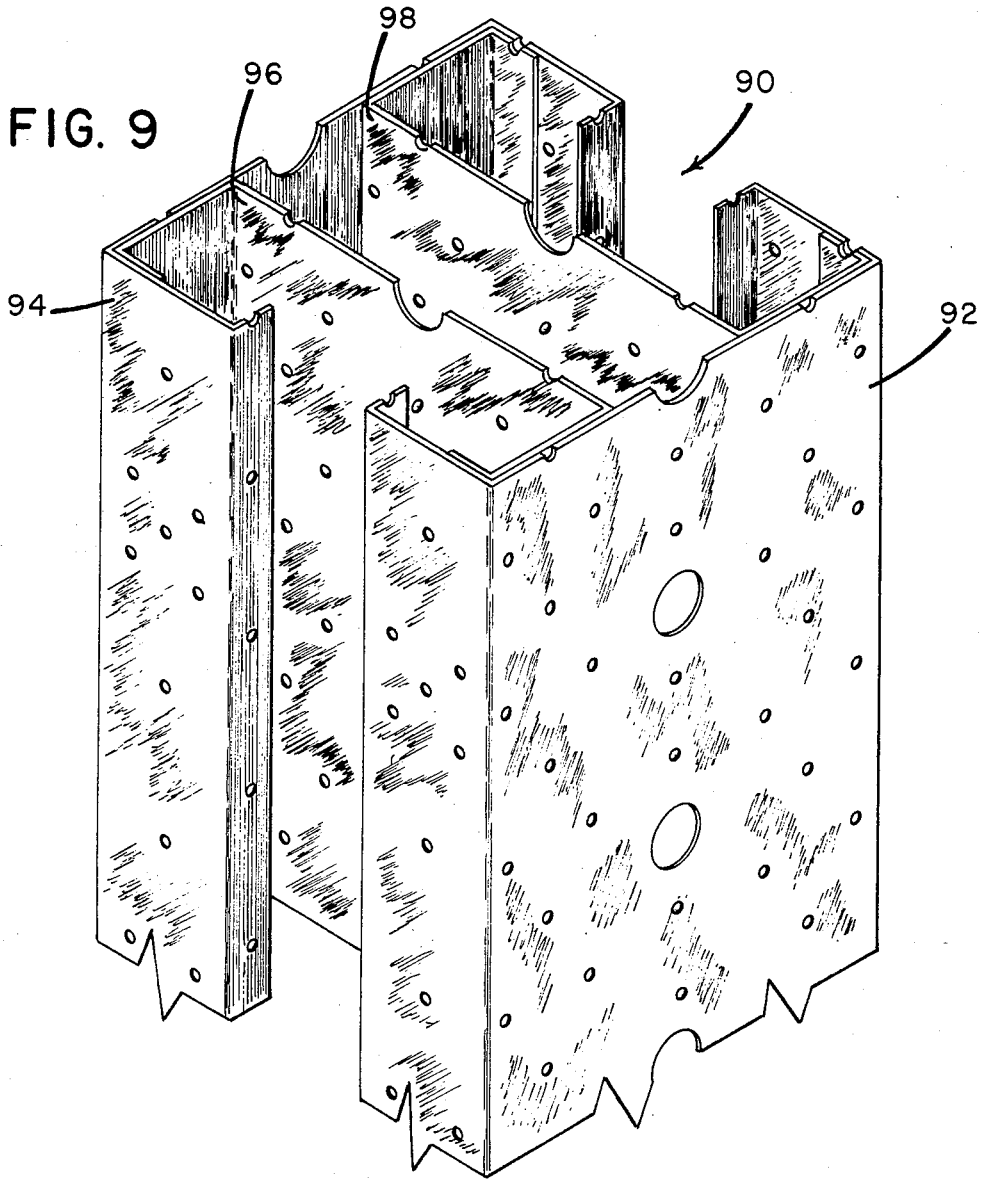
FIG. 9 is a perspective view of a second compound component according to the invention.
Figure 10:
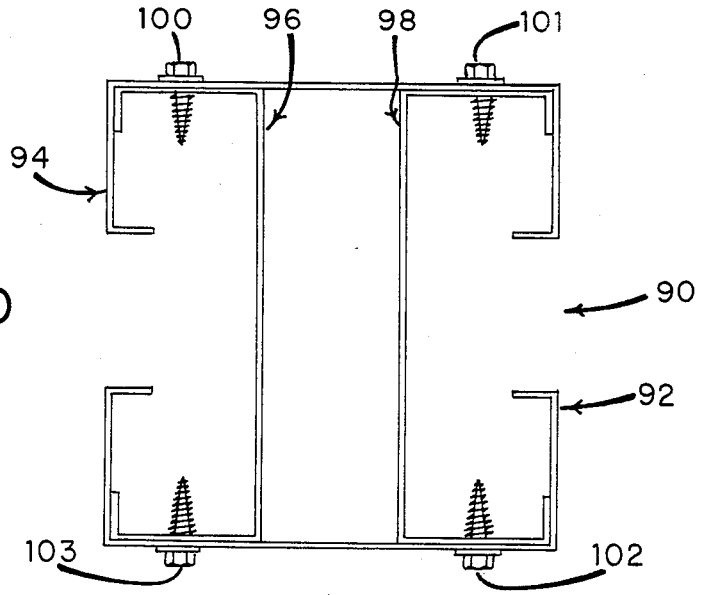
FIG. 10 is a cross section of the compound component of FIG. 9.

Another compound component according to the invention is depicted in FIGS. 9–10. In this embodiment the compound component 90 is produced by the interconnection of four standard components 92, 94, 96, and 98 according to the invention. The components 92, 94 are in parallel spaced relation to one another with their inwardly directed flanges directly opposite. Corners formed by the inwardly directed flanges in side portions of the components 96 and 98 nest snugly inside the corners formed by the web portions and side portions of the opposing components 92, 94. The position of apertures in the girder members as described above is such that apertures in the side portions align with apertures from the laterally centered longitudinal row separating the pentads and center apertures of the pentads in the flange portions align with apertures from the middle rows in the web portions to receive suitable fastening structures such as scews 100–103. In this manner a very closely interknit compound component is produced with great strength.

Figure 11:
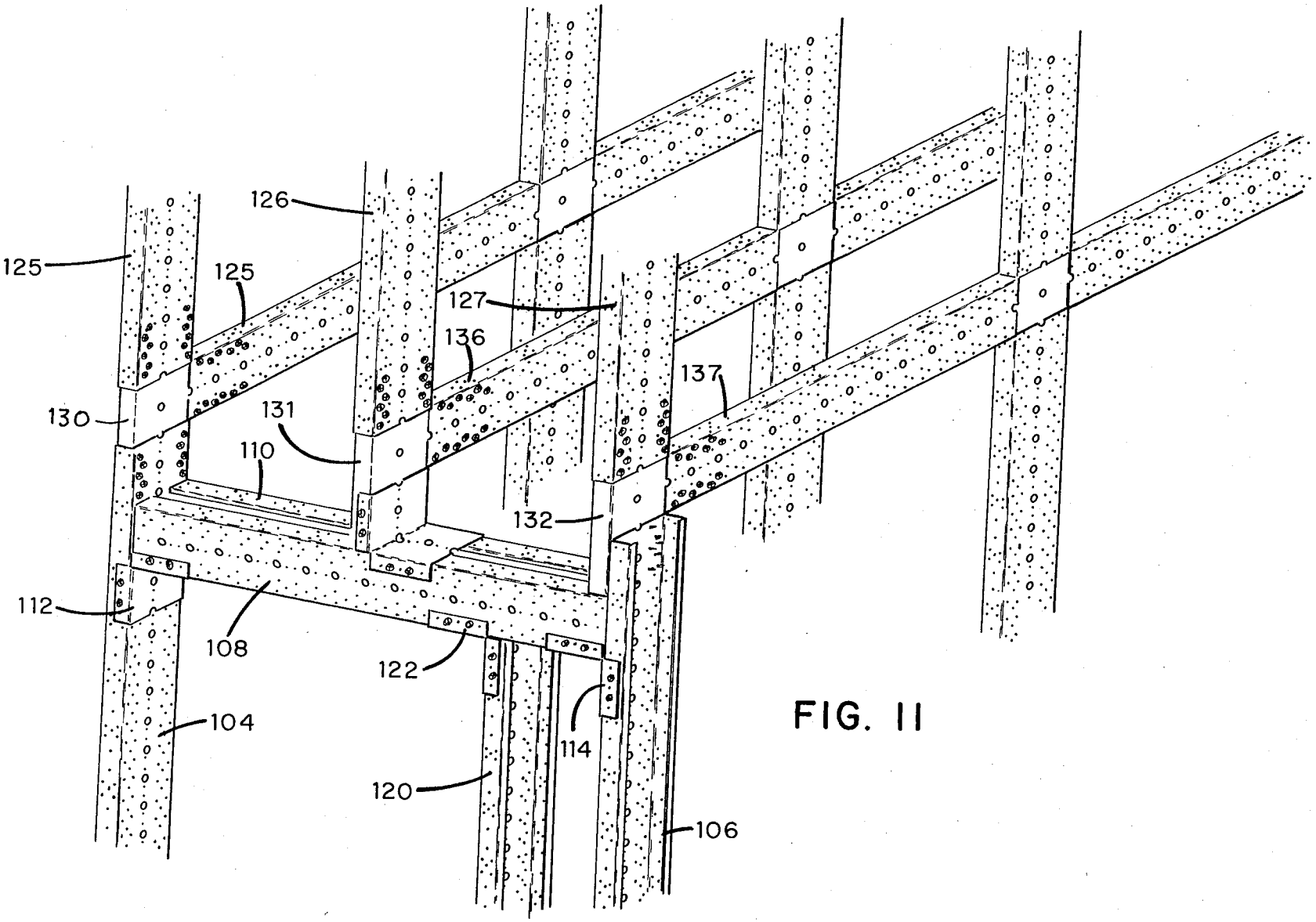
FIG. 11 is a perspective view of a portion of a structure framed with components according to the invention.

Components according to the invention can be combined in innumerable ways to produce building structures of virtually any design. A portion of one such design is shown in FIG. 11. In this Figure, a door frame is fashioned between studs 104, 106. The top of the door frame is formed by parallel studs 108, 110, which are secured by brackets 112, 114. A framing stud 120 is secured in place by bracket 122. Second story studs 125–127 are interconnected with the door frame by means of adaptor members 130–132 respectively. Floor joists 135–137 may likewise be connected to the adaptor members 130–132 respectively. It can be seen that the precise provision of apertures in the component can provide for great versatility in the manner in which studs according to the invention can be interconnected.

Figure 12:
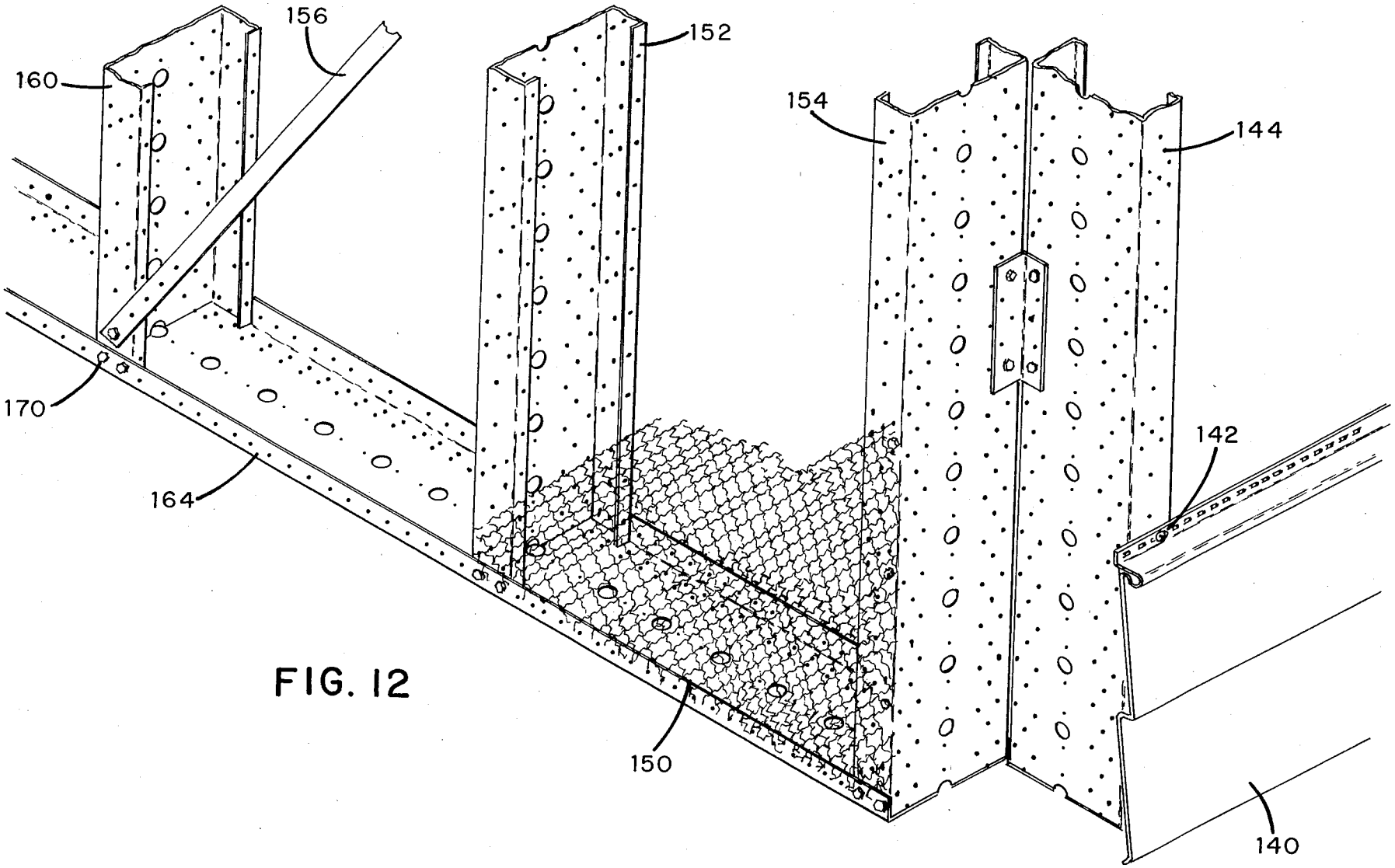
FIG. 12 is a perspective view of portion of a structure framed with components according to the invention and showing the attachment of additional structure.
Figure 13:
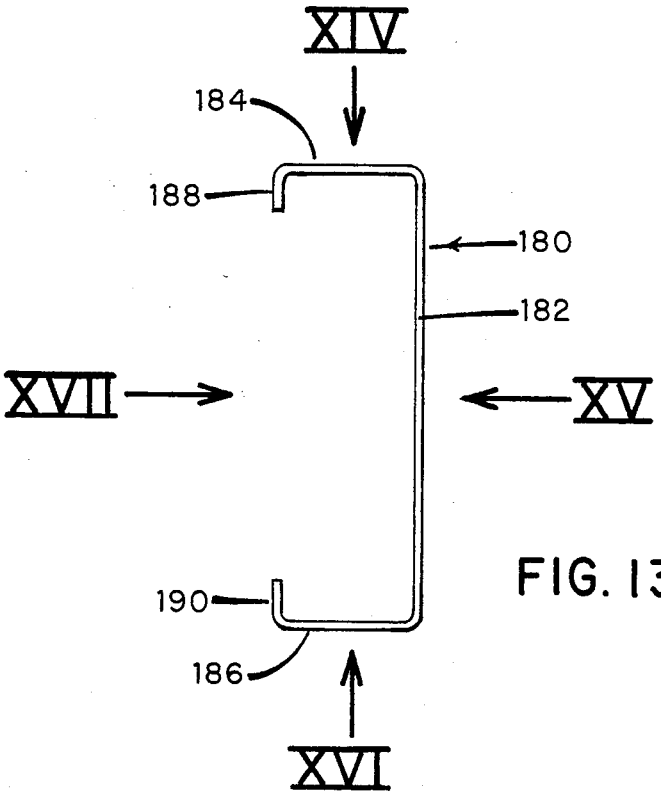
FIG. 13 is a cross section of an alternative component according to the invention.
Figure 14:
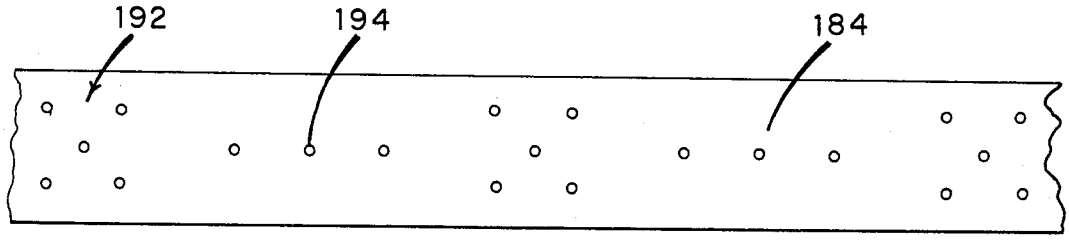
FIG. 14 is a plan view of the alternative component taken according to the arrow XIV in FIG. 13.
Figure 15:
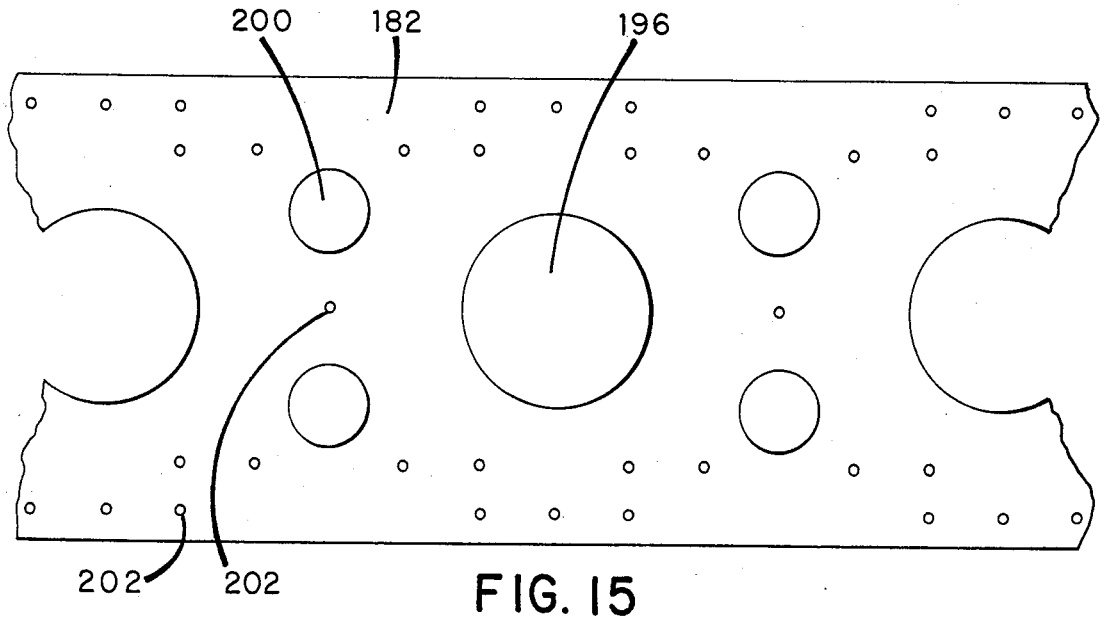
FIG. 15 is a side elevation of the alternative component according to the arrow XV in FIG. 13.
Figure 18:
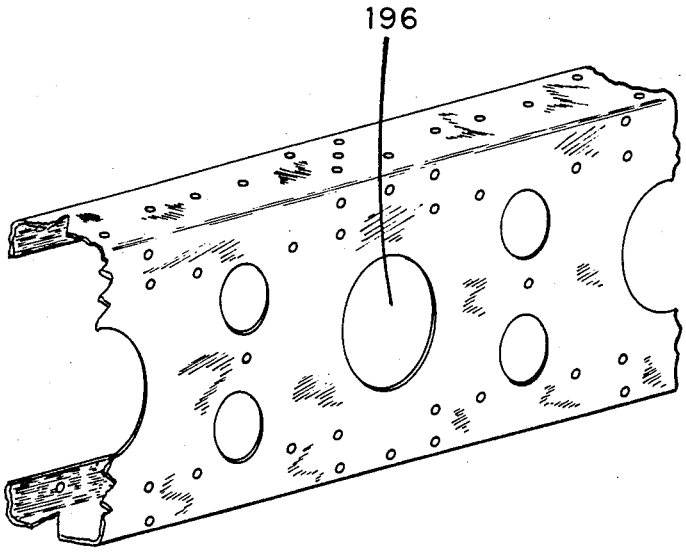
FIG. 18 is a perspective view of the alternative component of Fig. 13.
Figure 16:
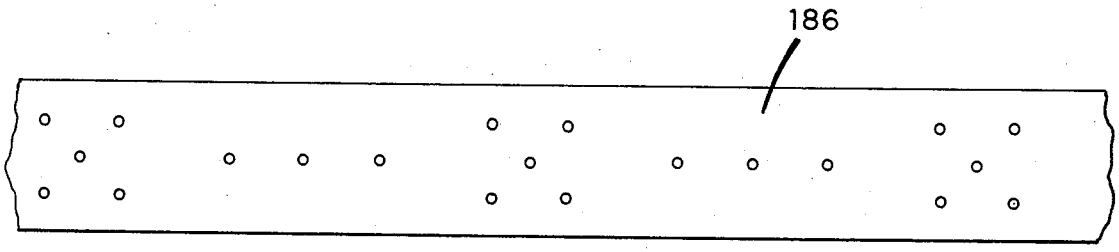
FIG. 16 is a bottom view of the alternative component according to the arrow XVI in FIG. 13.
Figure 17:
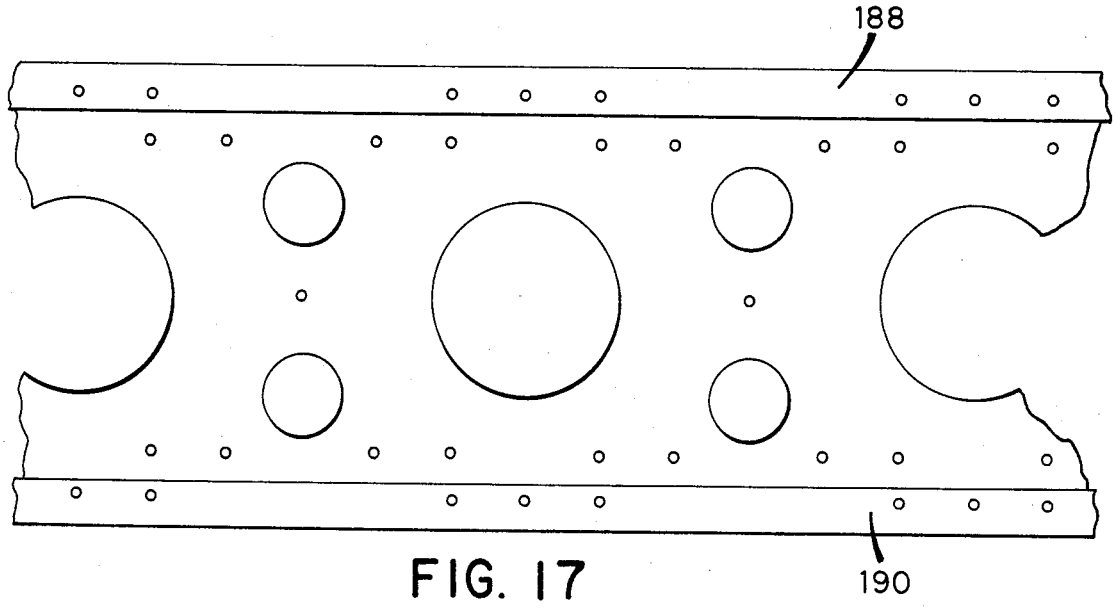
FIG. 17 is a side elevation of the alternative component according to the arrow XVII in FIG. 13.

The manner in which the components according to the invention can be connected to other building structures is depicted in FIG. 12. Exterior panelling 140 can easily be attached to the studs by the placement of suitable fastening structures such as screw 142 through apertures in the exterior panel 140 which are aligned with apertures in the stud 144. Similarly, metal lathe 150 can easily be attached to the studs by passing suitable fastening structures such as screws, into apertures in the studs 152, 154. Additional bracing such as strap 156 may likewise be affixed to the apertures in the side portion of stud 160. The studs 152, 154, and 160 are easily secured to a track member 164, which can in turn be secured to the footing, by suitable fastening structures such as screws 170. The screws 170 are readily affixed to the studs due to the precise alignment of apertures in the studs according to the invention with apertures in track 164.

Additional embodiments of the invention are possible. One such alternative is shown in FIGS. 13–18. The component 180 is seen to be of substantially squared-off C-shaped cross-section, with a web portion 182, flange portions 184, 186 and inwardly directed lips 188, 190. Pentad patterns 192 as previously described are spaced by a single longitudinal row of apertures 194 down the center of the flange portions 184, 186. The web portion 182 is provided with a longitudinal row of very large diameter apertures 196 at the center of the web portion. These apertures allow passage of wiring and plumbing and also decrease the total weight of the component. Longitudinally spaced medium diameter apertures 200 are provided on each lateral side of the lateral center of the web portion and in longitudinally alternating alignment with the large diameter apertures 196. Small diameter apertures 202 are provided at each lateral side of the web portion 182 and at the lateral center of the web portion in alternating longitudinal alignment with the large diameter apertures 196.

Figure 19:
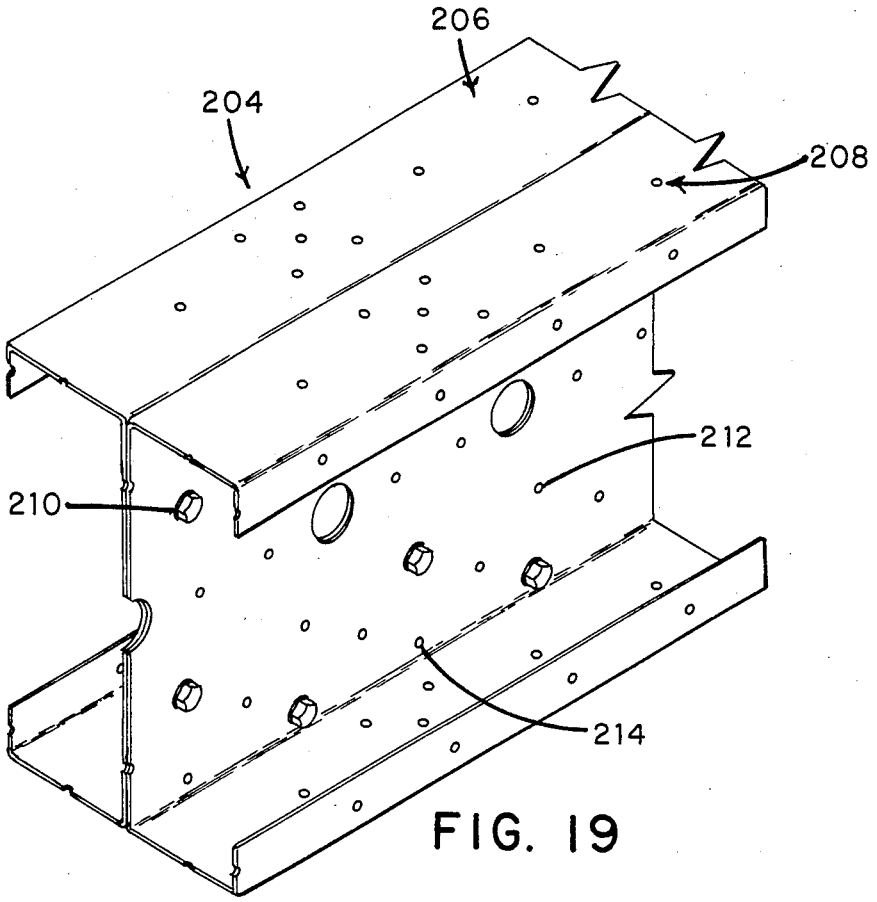
FIG. 19 is a perspective view of a web-to-web compound component according to the invention.
Figure 20:
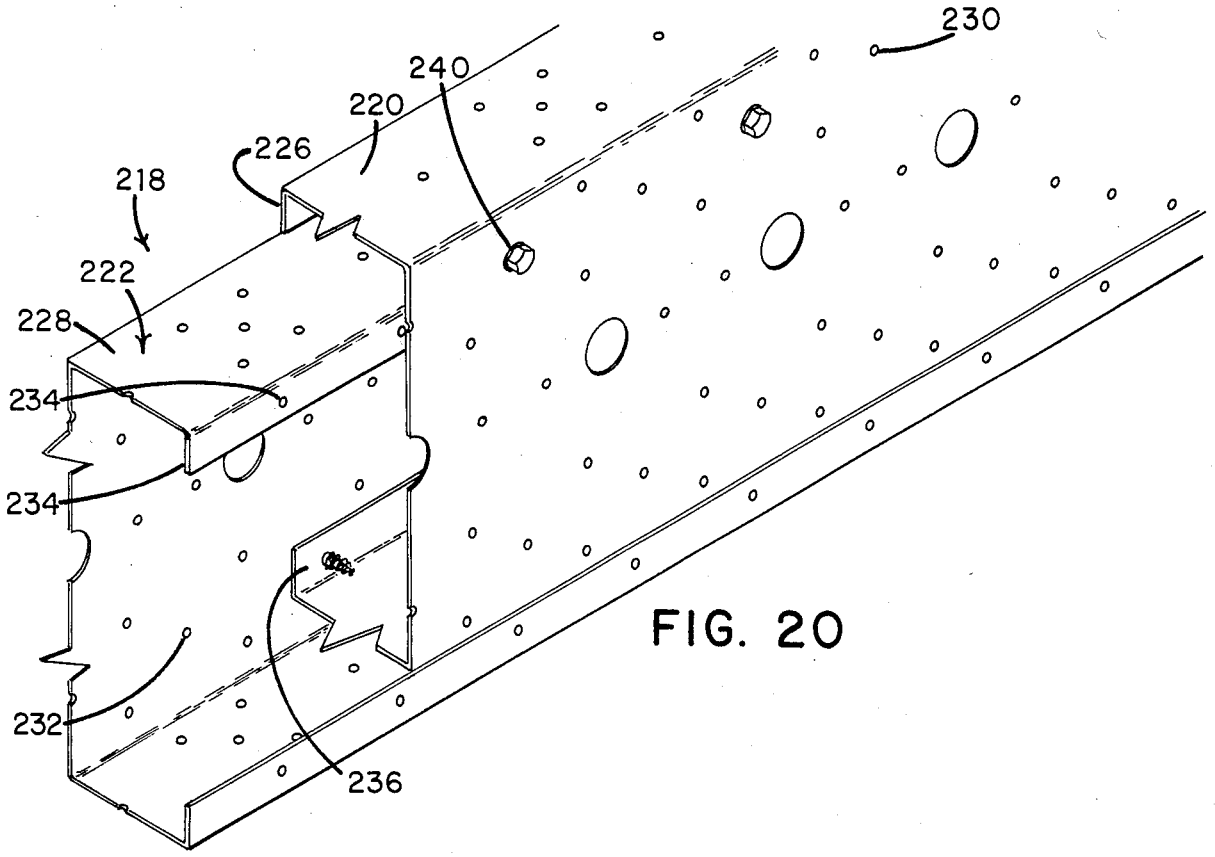
FIG. 20 is a perspective view of an interknitted compound component according to the invention.
Figure 21:
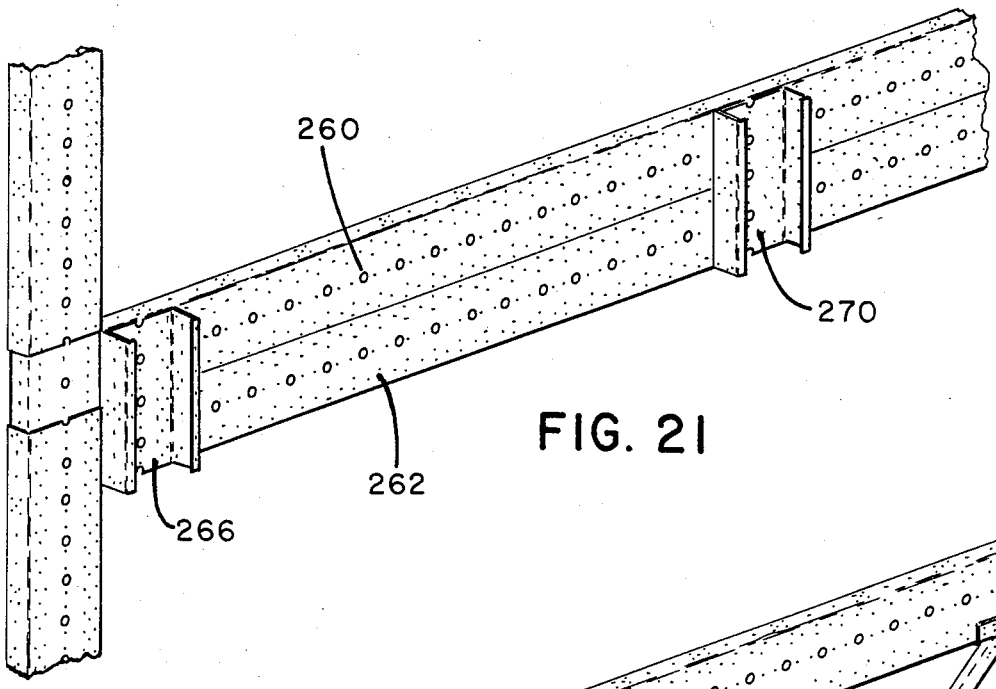
FIG. 21 is a perspective view of a reinforced beam compound component according to the invention.
Figure 22:
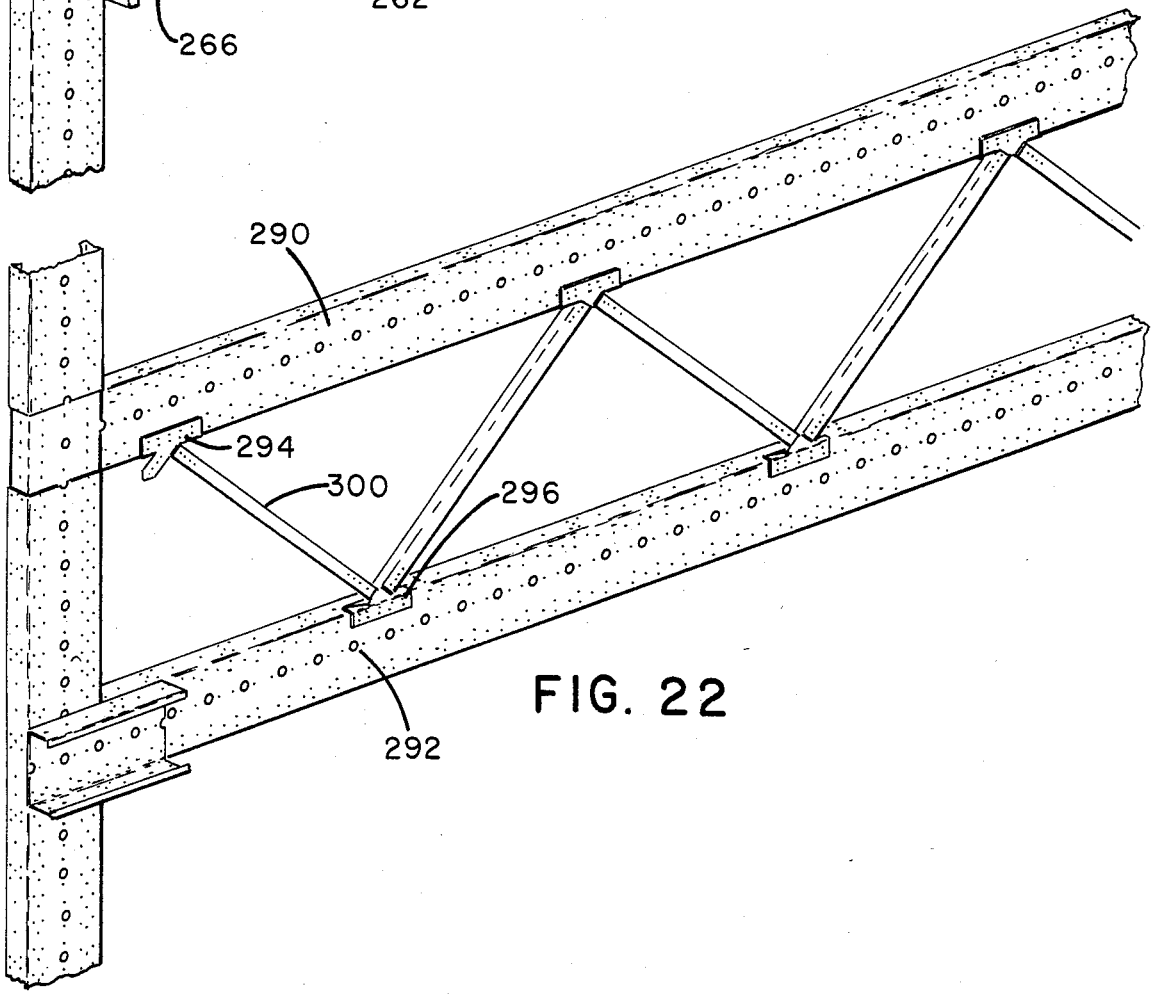
FIG. 22 is a perspective view of a component according to the invention with additional bracing.

The structural component according to the invention can be combined in dual components. FIG. 19 depicts such a dual component 204 formed by two structural components according to the invention 206 and 208. The components are aligned web-to-web such that apertures in the innermost rows 212 and outermost rows 214 align to receive suitable fastening structure such as screws 210. An alternative dual component 218 is shown in FIG. 20. The dual component 218 comprises two components according to the invention 220 and 222 in staggered face-to-face alignment with the lip portion 226 of the component 220 nesting on the flange 228 of the component 222. In this manner, apertures from respective middle rows 230 and 232 align with apertures in the respective lip portions 234 and 236 to receive suitable fastening means such as screw 240. FIG. 21 depicts a dual component comprising two girder members 260 and 262 according to the invention held in place by cross braces 266, 270 which are formed by components according to the invention. These cross bracing components are fastened in perpendicular web-to-web relation across the two girder members 260 and 262 by suitable fastening structure. FIG. 22 depicts two components according to the invention 290 and 292 which are held cooperatively for added strength by bar joist adaptors 294 and 296 across which are affixed angle or channel structure 300. The bar joist adaptors 294 and 296 are affixed through suitable fastening structure through the web apertures in the components.

The structural component of the invention can be manufactured in various sizes and from a variety of materials including galvanized steel, plastics and other materials as would be apparent to one skilled in the art. These materials should be selected for strength and resistance to deterioration in the expected environment. A preferable thickness for a galvanized steel component would be sixteen to twenty gauge, Manufacturers Standard Gauge. This would correspond to thickness between 0.0359″ (0.1 cm) and 0.0598″ (0.15 cm).

Components according to the invention are particularly useful in building construction systems. It would be apparent to one skilled in the art, however, that the inventive concepts disclosed herein would be applicable in a number of settings. It would be possible, for example, to construct small structures, such as sheds and carports, according to the invention. It might also be possible to utilize the concepts on as even smaller scale for the erection of models for architecture or educational purposes.

This invention may be embodied in other forms without departing from the spirit or essential attributes thereof, and accordingly, references should be made to the appended claims, rather than the foregoing specification, as indicating the scope of the invention.

I claim:

1. A modular structural component for framing buildings and the like, comprising:

an elongated member having a C-shaped cross-section formed by a central web portion and two flange portions attached to the web portion;

the web portion having a first pattern of apertures, the first pattern of apertures comprising longitudinally spaced large diameter pilot holes adapted to receive a pilot pin from a cut-off die mechanism, and a longitudinally repeating pattern of smaller diameter apertures, the smaller diameter apertures being provided as three spaced longitudinal rows of apertures at each lateral side of the pilot holes, including an innermost row adjacent the pilot holes, a middle row and an outermost row, the longitudinal spacing between apertures in the respective rows being equal, the innermost and outermost rows of apertures being laterally aligned, the middle rows of apertures being staggered relative to the innermost and outermost rows, providing apertures at the longitudinal midpoints between successive apertures in the innermost and outermost rows; and, the flange portions having a second pattern of apertures, the second pattern of apertures comprising a longitudinally repeating pattern including a pentad with a hole at each corner defining an imaginary rectangle, and a hole at the center of each rectangle, the first and second patterns of apertures repeating in multiples of a predetermined length, whereby the components can be formed in multiples of said predetermined length and connected and interconnected to form structures of innumerable sizes and shapes.

2. The component of claim 1 wherein the imaginary rectangle is a square.

3. The component of claim 2 further comprising at least one longitudinal row of apertures separating the pentads in the second pattern of apertures.

4. The component of claim 3 wherein each longitudinal row of apertures separating the pentads in the second pattern of apertures comprises two apertures.

5. The component of claim 2 wherein the repeating imaginary square pattern in the second pattern is continuous, the corner apertures of each pentad serving as corner apertures for succeeding pentads.

6. A modular structural component for erecting buildings and the like, comprising:

an elongated member having a substantially squared-off C-shaped cross-section with a web portion, two flange portions attached to the web portion and two inwardly directed lips on the flange portions;

the web portion having a first pattern of apertures comprising longitudinally spaced larger diameter apertures at the center of the web portion, and smaller diameter apertures at each lateral side of the large apertures;

a repeating pattern of apertures in each flange portion including a pentad with an aperture at each corner defining an imaginary rectangle and an aperture at the center of the rectangle; and, a plurality of apertures in the inwardly directed lips, the apertures in the inwardly directed lips being aligned with apertures in the first pattern of apertures along a line perpendicular to the lips and to the web portion, whereby components can be connected and interconnected in innumerable ways to form a variety of building structures.

7. The component of claim 6 wherein the pattern of smaller diameter apertures in the first pattern of apertures comprises three spaced longitudinal rows of apertures at each lateral side of the large diameter apertures, an innermost row adjacent the large diameter apertures, a middle row and an outermost row.

8. The component of claim 7 wherein longitudinal spacing between apertures in the respective rows is equal.

9. The component of claim 8 wherein the innermost and outermost rows of apertures are laterally aligned.

10. The component of claim 9 wherein the middle rows of apertures are staggered relative to the innermost and outermost rows, providing apertures at longitudinal midpoints between successive apertures in the innermost and outermost rows.

11. The component of claim 10 wherein the apertures in the inwardly directed lips are provided in longitudinal rows.

12. The component of claim 11 wherein the longitudinal rows of apertures in the inwardly directed lips are equally spaced and longitudinally aligned with the outermost rows of apertures in the web portion.

13. The component of claim 6 wherein at least one longitudinal row of apertures separates the pentads in each flange portion.

14. The component of claim 11 wherein each longitudinal row of apertures separating the pentads comprises two apertures.

* * * * *